US006023823A

United States Patent [19]

Yeh et al.

[11] Patent Number: 6,023,823

[45] Date of Patent: Feb. 15, 2000

[54] METHOD AND APPARATUS FOR TREATING STRAND-LIKE MATERIAL

[75] Inventors: Ling Yeh, Anderson; James M. Philyaw, Sandy Springs; James P. Sullivan, Fair Play, all of S.C.

[73] Assignee: BASF Corporation, Mt. Olive, N.J.

[21] Appl. No.: 09/273,900

[22] Filed: Mar. 22, 1999

[51] Int. Cl.[7] ..... B65H 54/00; B65H 51/02

[52] U.S. Cl. ..... 28/101; 28/219; 28/289; 242/363

[58] Field of Search ..... 28/101, 289, 219, 28/221, 266; 242/363, 361, 361.4, 361.1, 361.3, 365.3, 366.2, 366; 226/108, 97.4; 68/5 D; 34/466, 236, 625

[56] References Cited

U.S. PATENT DOCUMENTS

| | | | |
|---|---|---|---|
| 3,430,312 | 3/1969 | Drummond | 28/289 |
| 3,469,796 | 9/1969 | Russell et al. | 28/289 |
| 3,683,650 | 8/1972 | Hirschburger | 68/5 D |
| 4,221,031 | 9/1980 | Gilbos | 28/281 |
| 4,414,756 | 11/1983 | Simpson | 34/23 |
| 4,432,501 | 2/1984 | Arendt et al. | 28/289 |
| 5,024,390 | 6/1991 | Enderlin | 28/289 |
| 5,325,301 | 6/1994 | Knoff et al. | 364/552 |
| 5,475,907 | 12/1995 | Hoover | 28/289 |
| 5,483,730 | 1/1996 | Hoover | 28/101 |
| 5,826,812 | 10/1998 | Hand | 242/363 |

*Primary Examiner*—Amy Vanatta

[57] ABSTRACT

The present invention provides an improved method and apparatus for uniformly treating strand-like material. The apparatus comprises a coiler head having a coiler diameter d and a conveyor belt having a belt width w, wherein the ratio of the coiler diameter d to the belt width w is from about 1.05:1 to about 1.40:1. The method comprises treating the strand-like material in such apparatus.

14 Claims, 2 Drawing Sheets

METHOD AND APPARATUS FOR TREATING STRAND-LIKE MATERIAL

FIELD OF THE INVENTION

The present invention relates generally to a method and apparatus for treating strand-like material. More particularly, the present invention relates to a method of heat treating such material to provide the material with dimensional stability and an apparatus for doing the same.

BACKGROUND OF THE INVENTION

Strand-like material, such as yarn, that is to be used as pile in cut pile carpets typically is prepared by cabling ("ply-twisting") together two or more single strands, heatsetting them with hot air and/or steam in their twisted condition, and finally drying them. The strands are heatset in the ply twisted configuration so that when the strands are tufted into carpet and cut, the plies will remain in their twisted condition without separating and matting during wear.

One known method of heatsetting a strand-like material involves passing the strand-like material through a Superba® continuous heatsetting machine. Generally, in the operation of a Superba heatsetting unit, the strand-like material is laid in loops on a conveyor belt that first moves through an atmospheric steam prebulker and then through a heating zone. In the prebulker, the strand-like material is heat relaxed to develop bulk in the material. In the heating zone, the strand-like material is treated with pressurized, saturated steam that is maintained at a high temperature according to the type of material to heatset the twist. Another known method involves passing the strand-like material through the heating zone of a Suessen continuous heatsetting machine. The Suessen unit treats the strand-like material with dry heat to heatset the twist.

While in the heating zone, it has been found that non-uniform conditioning to the strand-like material may occur. The non-uniform conditioning leads to irregularities such as, for example, streaking and chevroning in a subsequent dyeing operation. For example, high bulk and high shrinkage of yarn while in the heating zone cause the mass of the yarn on the belt to become too dense to be heatset uniformly. When the yarn is then made into a carpet during a standard tufting operation and dyed using conventional dyeing equipment, visual examination reveals a non-uniform appearance, for example, streaks and chevrons, in the dyed carpet.

While some improvement in carpet uniformity may be seen by reducing yarn speed, the result is low productivity, which is not cost effective. Increasing yarn speed to increase productivity, however, decreases the dwell time in the heating zone, which results in carpet non-uniformity. Another problem with high throughput speeds is the propensity of the strand-like material to tangle. Once this occurs, the machine must be shut down and allowed to cool before the material may be untangled.

The Superba® TVP2S heatsetting machine has increased belt width and coiler diameter (both increased from 200 mm to 260 mm). While these modifications improve machine throughput of strand-like material, they do not address the problems of productivity and carpet uniformity. An additional limitation is that fact that one would have to buy this new equipment at significant cost as opposed to modifying existing equipment at a significantly lower cost.

A method and apparatus for overcoming the non-uniform conditioning of strand-like material while increasing throughput and productivity is, therefore, desired.

SUMMARY OF THE INVENTION

It is, therefore, an object of the present invention to overcome the irregularities in dyed carpet made from strand-like material that has been heatset.

Another object of the present invention is to provide a method that ensures uniform treatment of a strand-like material, as well as an apparatus for uniformly treating strand-like material.

Yet another object of the present invention is to improve throughput and productivity of strand-like material without adversely affecting uniformity.

Thus, according to the present invention, there is provided an apparatus for treating strand-like material comprising a coiler head having a coiler diameter d, a treatment zone for treating the material, and a conveyor belt having a belt width w for transporting the material through the treatment zone, wherein the ratio of the coiler diameter d to the belt width w is from about 1.05:1 to about 1.40:1.

Further according to the present invention, there is provided a process of treating strand-like material comprising drawing the material from a source and passing it through a coiler head that has a coiler diameter d, laying the material in loops on a conveyor belt that has a belt width w and conveying the material through a treatment zone, treating the material in the treatment zone, and drawing the material off the conveyor belt, wherein the ratio of the coiler diameter d to the belt width w is from about 1.05:1 to about 1.40:1.

The above and other objects, effects, features, and advantages of the present invention will become more apparent from the following detailed description of the preferred embodiments thereof

DETAILED DESCRIPTION OF THE PREFERRED EMBODIMENTS

To promote an understanding of the principles of the present invention, descriptions of specific embodiments of the invention follow, and specific language is used to describe the same. It will nevertheless be understood that no limitation of the scope of the invention is intended by the use of this specific language and that alterations, modifications, equivalents, and further applications of the principles of the invention discussed are contemplated as would normally occur to one of ordinary skill in the art to which the invention pertains.

Broadly, the present invention is an apparatus for treating strand-like material comprising a coiler head having a coiler diameter d, a treatment zone for treating the material, and a conveyor belt that has a belt width w for transporting the material through the treatment zone, wherein the ratio of the coiler diameter d to the belt width w is from about 1.05:1 to about 1.40:1.

The present invention also embodies a method of treating a strand-like material comprising drawing the material from a source and passing it through a coiler head that has a coiler diameter d, laying the material in loops on a conveyor belt that has a belt width w and conveying the material through a treatment zone, treating the material in the treatment zone, and drawing the material off the conveyor belt, wherein the ratio of the coiler diameter d to the belt width w is from about 1.05:1 to about 1.40:1.

Many different kinds of yarns and fibers may be processed according to the present invention including, without limitation, nylon, polyester, poly-trimethylene terephthalate, and polypropylene and combinations thereof.

Figure 1:
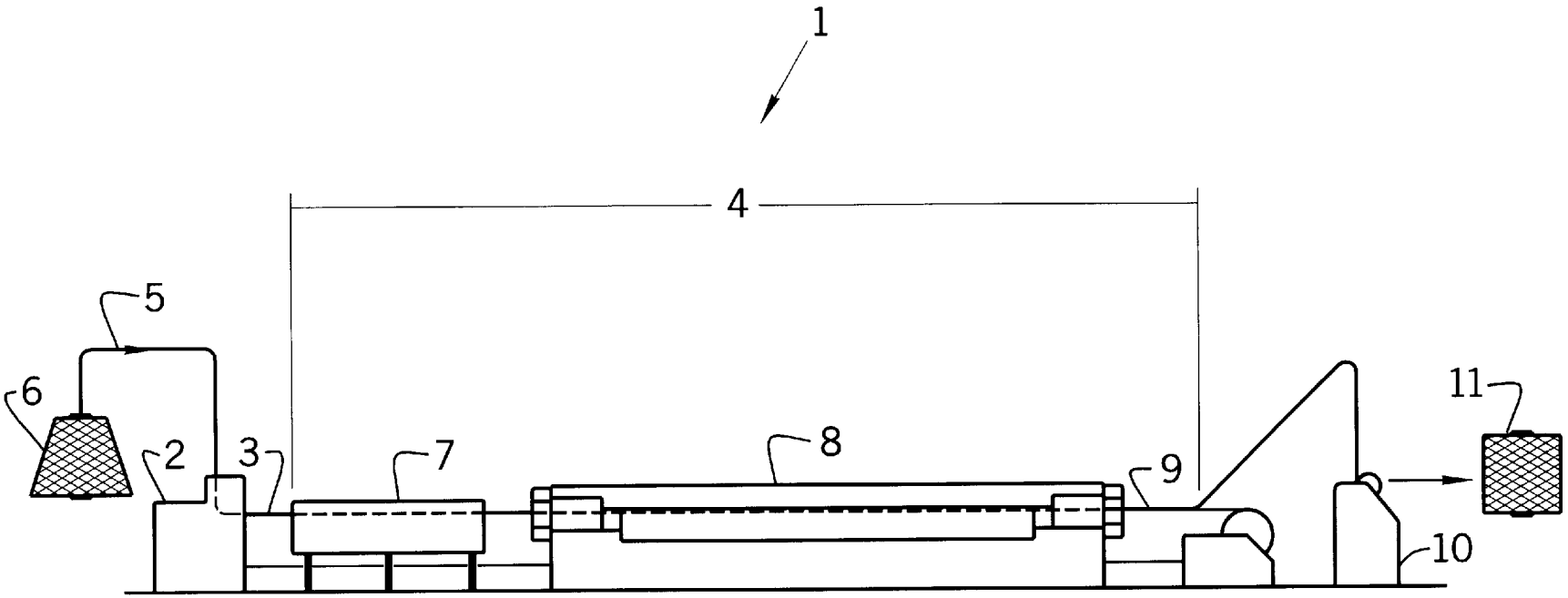
FIG. 1 shows the schematic side view of the apparatus for treating the strand-like material in accordance with the present invention.

The device 1 depicted in the drawings for performing the method in accordance with the present invention comprises, as can be seen from FIG. 1, a coiler head 2, a conveyor belt 3, and a treatment zone 4. When the device 1 is operated, the strand-like material 5, in this case cabled BCF ("bulked continuous filament") yarns, is taken off a spool 6 and, with the aid of the coiler head 2, laid on the conveyor belt 3 in loops in a manner to be described in more detail. The conveyor belt 3 comprises a continuous thin sheet of perforated stainless steel and has a belt width w.

Figure 2:
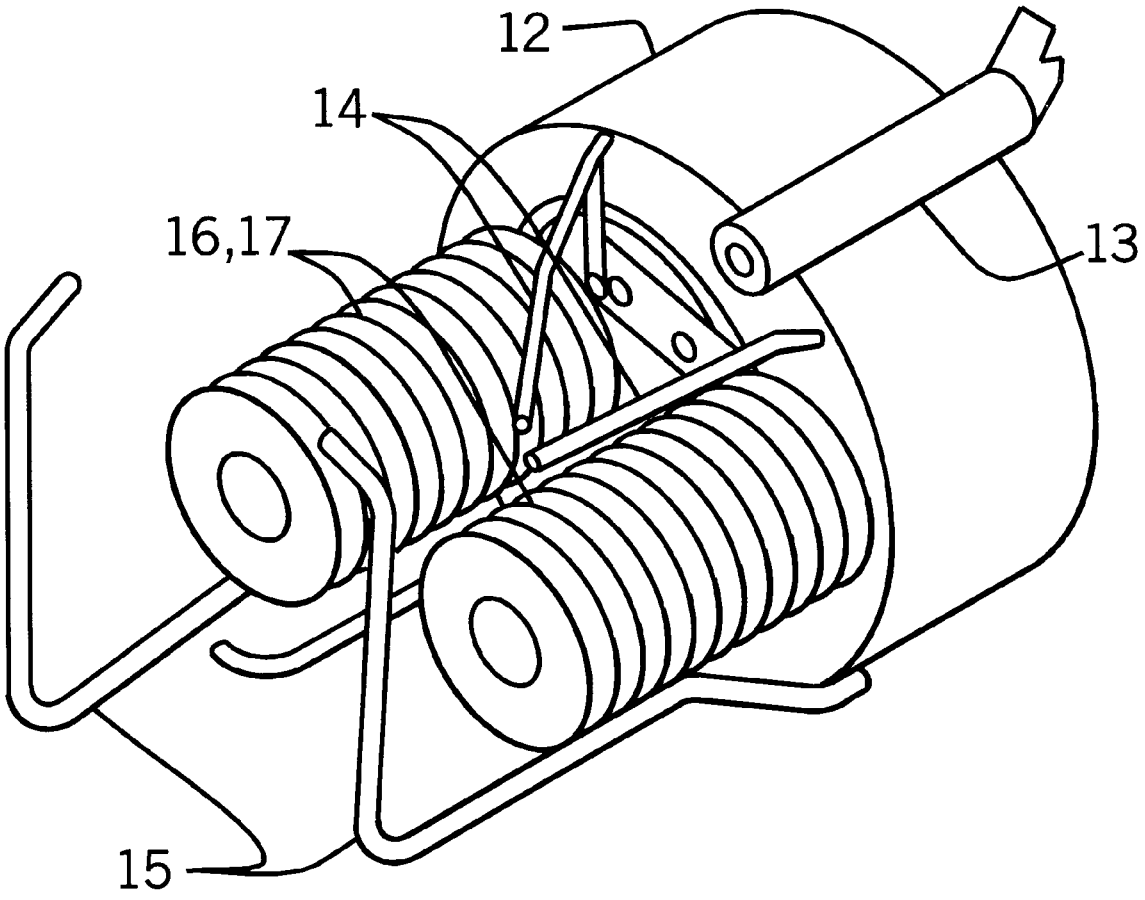
FIG. 2 is a schematic view of the coiler head used in the apparatus and method according to the present invention.

Referring now to FIG. 2, there is shown the coiler head 2, which has a coiler diameter d. The coiler head 2 comprises a gear housing 12, a yarn feed tube 13, spreader fingers 14, 15 and feed screws 16, 17. When the yarn 5 is taken off of spool 6, the yarn 5 is pulled through the yarn feed tube 13 and looped around spreader fingers 14, 15. The yam feed tube 13 is driven by a gear, pulley, and motor combination system (not shown). Feed screws 16, 17 convey the looped yarn downward and lay it in loops on the conveyor belt 3. The coiler diameter d is determined by measuring the width of the looped yarn when the yarn 5 is laid on the conveyor belt 3.

In order to provide uniform conditioning of the strand-like material, it is critical that the ratio of the coiler diameter d to the belt width w be in the range of from about 1.05:1 to about 1.40:1. Therefore, in accordance with the method and apparatus of the present invention, the coiler head 2 should have a diameter d and the conveyor belt 3 should have a width w such that the ratio of the coiler diameter d to the belt width w be is from about 1.05:1 to about 1.40:1 and, preferably, is from about 1.10:1 to about 1.30:1.

After the yarn 5 is laid in loops on the conveyor belt 3, conveyor belt 3 carries the looped yarn downstream to treatment zone 4. The belt 3 passes slowly and continuously through treatment zone 4, which may comprise a prebulker 7, followed by a heatsetting chamber 8, and a dryer 9. In the heatsetting chamber 8, the looped yarn is exposed to heat, preferably in the form of steam and/or hot air, in order to heatset it.

After the material 5 has left treatment zone 4, the material 5 is cooled on the belt 3 before being taken off the belt via a take-up device 10 and wound on a spool 11 by means of a winder (not shown). The resulting heatset, textured carpet yarn is ready for tufting into textured carpet by conventional tufting procedures.

It has been found that modifying the ratio of the coiler diameter d to the belt width w in the range of about 1.05:1 to about 1.40:1 results in an increase in production of up to a 20 percent, as well as a reduction in the tendency of the strand-like material to tangle (i.e., improved throughput).

Before treating strand-like material in accordance with the present invention, the material may be dyed with conventional dyes such as, for example, metalized and non-metalized acid dyes. Usual dyebath conditions can be employed. The following general conditions are exemplary and not intended to be limiting. A dyebath is prepared at a volume equal to about 20 times the weight of the articles to be dyed. Processing chemicals are added including a chelating agent to prevent the deposition or complexing of metal ions in hard water, a dye leveling agent, and, in the case of metalized acid dyes, an acid donor to slowly lower the dyebath pH. The dyestuff is added, and the dyebath pH is adjusted. The solution is heated to the desired temperature of typically about from 95° C. to about 110° C. at a rate of from about 0.5° C. to about 3.0° C. per minute and is held at that temperature for about 30 minutes to about 60 minutes. The dyebath is cooled or emptied, and the strand-like material is thoroughly rinsed with fresh water. The dyed material is dried in a tumble drier or an oven or is passed over heater cans.

Dyeing may also take place after the strand-like material has been tufted into carpet in accordance with conventional techniques known to those skilled in the art such as, for example, subjecting the carpet to a continuous dyebath.

Alternatively, the strand-like material may be colored in the melt prior to fiber-formation (i.e., solution dyed) using conventional solution-dyeing techniques. The following general conditions are exemplary and not intended to be limiting. The polymer is melted and colored with a colorant selected from the group consisting of pigments, dyes, any colored compound with properties between pigments and dyes, and combinations thereof. The colored polymer is then spun into fibers or fabric according to conventional methods such as, for example, those disclosed in U.S. Pat. No. 4,983,448 to Karageorgiou, U.S. Pat. No. 5,487,860 to Kent et al., and U.S. Pat. No. 4,918,947 to Speich.

Carpet may be made from the strand-like material treated in accordance with the present invention by any of the conventional carpet-making techniques known to those skilled in the art. The carpet may be cut-pile, berber, unlevel loop, level loop, or any other style according to the popular fashion. By way of example, in the case of cut-pile carpeting, the yarn is tufted into a primary backing and cut to form cut-pile carpeting. The primary backing material may be woven or nonwoven jute, nylon, polyester, polypropylene, etc. The cut-pile carpeting is dyed to the desired shade. The primary backing is then coated with a suitable latex material such as conventional styrene-butadiene ("SB") latex, vinylidene chloride polymer, or vinyl chloride-vinylidene chloride copolymers. It is common practice to use fillers such as calcium carbonate to reduce latex costs. The final step is to apply a secondary carpet backing to the latex-based adhesive. The secondary backing may be jute, polypropylene, nylon, polyester, etc. The carpet may be foam backed or not. The carpet can be a variety of pile weights, pile heights, and styles. There is not currently believed to be any limitation on the carpet style.

Increasing the ratio of the coiler diameter d to the belt width w about 1.05:1 to about 1.40:1 improves carpet uniformity by reducing the presence of streaks and chevrons.

The invention will be further described by reference to the following detailed examples. The examples are set forth by way of illustration and are not intended to limit the scope of the invention.

EXAMPLES 1–8

Regular acid-dyeable yarns of nylon 6 (BS-700A supplied by BASF Corporation of Mt. Olive, N.J.) are melt-spun, drawn, and bulked. The yarns have a denier of about 1100 (about 1250 dtex). The yarns are then two-ply cabled to 3.75 twists per inch (146.4567 twists per meter).

Upon completion of cabling, the twisted yarns are heatset using a Superba® TVP heatsetting machine by the process known by those skilled in the art. The yarn speed is set at 550 mpm ("meters per minute") or 700 mpm. The prebulker temperature is about 210° F. (about 98.9° C.). The belt speed is about 16.7 mpm. The heating/treatment zone is operating at a temperature of about 255° F. (about 123.9° C.) and a pressure of about 22 psi ($15.1642\times10^4$ Pa).

Yarns of the invention (Examples 2, 4, 6, and 8) are heatset using the method and apparatus represented by FIG. 1. In particular, the yarns are heatset using a Superba® heatsetting machine having a modified coiler that has a diameter of about 230 mm and a belt width of 200 mm. The ratio of coiler diameter to belt width is, therefore, about 1.15:1. Improvements in both throughput and productivity are seen over the control yarns. Specifically, there is an increase in production output of about 15 percent.

Control yarns (Examples 1, 3, 5, and 7) are prepared under identical conditions but are heatset using a Superba heatsetting machine having both a coiler diameter and a belt width of 200 mm. The ratio of coiler diameter to belt width is, therefore, 1:1. In producing the control yarns, more tangling is evident.

The heatset yarns are tufted into carpets at settings of $\frac{1}{8}^{th}$ inch ($3.1750\times10^{-3}$ m) gauge, $\frac{5}{8}^{th}$ inch ($1.5875\times10^{-2}$ m) cut-pile height, 9 stitches per inch (354.3307 stitches per meter), and 36 ounces per square yard (1.2206 kilograms per square meter) face weight using a cut-pile tufter. The tufter is equipped with a shifting device that is used in making the straight set ("SS") style carpets of Examples 1–4. The shifting device is deactivated for making straight set, straight tuft ("SSST") style carpets of Examples 5–8.

The cut-pile carpets are continuously dyed to a beige shade with acid dyes using conventional dyeing equipment and dyeing techniques known to those skilled in the art. The dyeing ingredients are listed in Table 1 below. The pump speed is about 218 liters per minute, and the carpet speed is about 40 feet per minute (12.1921 meters per minute).

TABLE 1

| INGREDIENT | AMOUNT (GRAMS PER LITER) |
|---|---|
| C.I. Acid Orange 156[1] | 0.078235 |
| C.I. Acid Red 361[2] | 0.076471 |
| C.I. Acid Blue 324[3] | 0.081176 |
| Chelating agent[4] | 0.500 |
| Dioctyl sulfosuccinate surfactant[5] | 3.000 |
| Alkylpolyglycol ether[6] | 1.000 |
| Anionic dye leveling agent[7] | 1.000 |
| Ammonium acetate[8] | 1.500 |
| Alkaline buffer[9] | 0.800 |
| Defoamer LBT-7[10] | 0.250 |

[1]Tectilon ® Orange 3G 200% from Ciba Specialty Chemicals of Greensboro, N.C.
[2]Tectilon ® Red 2B 200% from Ciba Specialty Chemicals of Greensboro, N.C.

TABLE 1-continued

| INGREDIENT | AMOUNT (GRAMS PER LITER) |
|---|---|

[3]Telon Blue BGL 200% from DySatr L.P. of Charlotte, N..
[4]Amquest N from American Emulsions Co. of Dalton, GA.
[5]Wetter DO8S 70% from MFG Chemicals, Inc. of Dalton, GA.
[6]Host CX NEW from Arrow Engineering of Dalton, GA.
[7]Arrosperse AC from Arrow Engineering Co. of Dalton, GA.
[8]Acetate buffer from Calloway Chemicals Co. of Columbus, GA.
[9]Alkaflo KDY from Sybron/Tanatex Co. of Wellford, S.C.
[10]Available from Rite Industrials Inc. of High Point, N.C.

The dyed carpets are subjectively ranked by a panel of graders based on the presence or absence of detectable streaks visually apparent in the carpets. Carpet uniformity ratings for Examples 1–8 are obtained by visually rating the carpet samples on a scale of 1.0 to 10.0, with 1.0 meaning the carpet is highly streaked and 10.0 meaning the carpet is free of streaks. A score of 6.0 means the carpet is acceptable. A panel of graders rated each carpet sample, and the average grade was then determined for each sample. The results of the ratings are summarized in Table 2.

TABLE 2

| Example/Type | Coiler Type | Ratio of Coiler Diameter to Belt Width | Yarn Speed (mpm) | Streak Rating |
|---|---|---|---|---|
| 1/SS | Standard | 1:1 | 550 | 6.0 |
| 2/SS | Modified | 1.15:1 | 550 | 6.5 |
| 3/SS | Standard | 1:1 | 700 | 5.5 |
| 4/SS | Modified | 1.15:1 | 700 | 6.0 |
| 5/SSST | Standard | 1:1 | 550 | 4.5 |
| 6/SSST | Modified | 1.15:1 | 550 | 5.0 |
| 7/SSST | Standard | 1:1 | 700 | 4.0 |
| 8/SSST | Modified | 1.15:1 | 700 | 5.0 |

The streak ratings of the carpets indicate an improvement in the streaking and chevroning (e.g., less streaks and chevrons, more uniform color) for the carpets where the yarn is heatset in accordance with the present invention.

Although the above Examples have been made using a Superba® heatsetting machine, the present invention applies to a Suessen heatsetting machine equipped with a pneumatic coiler and a continuous belt such as one made by American Linc. It is important that the ratio of the coiler diameter to the belt width be in the range of about 1.05:1 to about 1.40:1.

While the invention has been described in connection with what is presently considered to be the most practical and preferred embodiment, it is to be understood that the invention is not to be limited to the disclosed embodiment, but on the contrary, is intended to cover various modifications and equivalents arrangements included within the spirit and scope of the appended claims.

What is claimed is:

1. A method for treating strand-like material comprising the steps of:

(a) drawing said material from a source;

(b) passing said material through a coiler head, said coiler head having a coiler diameter d;

(c) laying said material in loops on a conveyor belt, said conveyor belt having a belt width w;

(d) conveying said material in loops by said conveyor belt through a treatment zone;

(e) treating said material in said treatment zone; and (f) drawing said material off of said conveyor belt, wherein the ratio of said coiler diameter d to said belt width w is from about 1.05:1 to about 1.40:1.

2. A method according to claim 1, wherein the step of treating said material in said treating zone comprises treating said material with steam.

3. A method according to claim 1, wherein the step of treating said material in said treating zone comprises treating said material with dry heat.

4. A method according to claim 1, wherein the ratio of said coiler diameter d to said belt width w is from about 1.10:1 to about 1.30:1.

5. A method according to claim 4, wherein the step of treating said material in said treating zone comprises treating said material with steam.

6. A method according to claim 4, wherein the step of treating said material in said treating zone comprises treating said material with dry heat.

7. An apparatus for treating strand-like material comprising:

(a) a coiler head having a coiler diameter d;

(b) a treatment zone containing means for treating said material; and (c) a conveyor belt for transporting the material through the treatment zone, said conveyor belt having a belt width w;

wherein the ratio of said coiler diameter d to said belt width w is from about 1.05:1 to about 1.40:1.

8. An apparatus according to claim 7, wherein said treatment zone comprises a means for treating said strand-like material with steam.

9. An apparatus according to claim 7, wherein said treatment zone comprises a means for treating said strand-like material with dry heat.

10. An apparatus according to claim 8, wherein said treatment zone further comprises a means for drying said strand-like material.

11. An apparatus according to claim 7, wherein the ratio of said coiler diameter to said belt width is from about 1.10:1 to about 1.30:1.

12. An apparatus according to claim 11, wherein said treatment zone comprises a means for treating said strand-like material with steam.

13. An apparatus according to claim 11, wherein said treatment zone comprises a means for treating said strand-like material with dry heat.

14. An apparatus according to claim 12, wherein said treatment zone further comprises a means for drying said strand-like material.

* * * * *